US008676554B2

(12) United States Patent
Ebisawa et al.

(10) Patent No.: US 8,676,554 B2
(45) Date of Patent: Mar. 18, 2014

(54) SIMULATION APPARATUS FOR MOTOR-DRIVEN COMPRESSOR SYSTEM AND THE SIMULATION METHOD THEREOF

(75) Inventors: Naoto Ebisawa, Ushiku (JP); Hideaki Orikasa, Tsuchiura (JP); Takeshi Miyanaga, Kasumigaura (JP)

(73) Assignee: Hitachi, Ltd., Tokyo (JP)

( * ) Notice: Subject to any disclaimer, the term of this patent is extended or adjusted under 35 U.S.C. 154(b) by 198 days.

(21) Appl. No.: 13/221,230

(22) Filed: Aug. 30, 2011

(65) Prior Publication Data

US 2012/0059635 A1 Mar. 8, 2012

(30) Foreign Application Priority Data

Sep. 2, 2010 (JP) ..... 2010-196425

(51) Int. Cl.
*G06G 7/48* (2006.01)

(52) U.S. Cl.
USPC ..... 703/7; 703/2; 703/4

(58) Field of Classification Search
USPC ..... 703/2, 7; 417/26, 29
See application file for complete search history.

(56) References Cited

U.S. PATENT DOCUMENTS

2009/0317260 A1* 12/2009 Mirsky et al. ..... 417/29
2012/0014812 A1* 1/2012 Blaiklock et al. ..... 417/26

FOREIGN PATENT DOCUMENTS

JP 10-333541 12/1998
JP 2009-47059 3/2009

OTHER PUBLICATIONS

Franciscus P.T. Willems ("Modeling and Bounded Feedback Stabilization of Centrifugal Compressor Surge", Technische Universiteit Eindhoven, 2000).*
Corina H.J. Meuleman ("Measurement and Unsteady Flow Modeling of Centrifugal Compressor Surge", Technische Universiteit Eindhoven, 2002).*
R. G. Kent ("Application of Basic Thermodynamics to Compressor Cycle Analysis", International Compressor Engineering Conference, 1974).*
Bohagen et al. ("Active surge control of compression system using drive torque", Norwegian University of Science and Technology, Trondheim, Norway, 2008).*

* cited by examiner

*Primary Examiner* — Omar Fernandez Rivas
*Assistant Examiner* — Iftekhar Khan
(74) *Attorney, Agent, or Firm* — Antonelli, Terry, Stout & Kraus, LLP.

(57) ABSTRACT

With a simulation apparatus for a system including a motor-driven compressor, a compressor that does not suffer from a driving torque shortage and surging, but can operate at low costs, can be provided.

A simulation apparatus for a motor-driven compressor system includes a simulation section in which a driving motor, a compressor driven by the driving motor, a suction throttle valve controlling the inlet flow rate of the compressor, and an anti-surge valve interposed between pipes for returning a part of gas discharged from the compressor to the inlet side of the compressor are translated into unit models and stored. The simulation apparatus further includes an input section through which designed specification data of the compressor is input, a data setting section storing the designed specification data, and a display section displaying unsteady-state Q-H characteristics and required driving torque obtained through simulation by the simulation section.

2 Claims, 4 Drawing Sheets

SIMULATION APPARATUS FOR MOTOR-DRIVEN COMPRESSOR SYSTEM AND THE SIMULATION METHOD THEREOF

BACKGROUND OF THE INVENTION (1) Field of the Invention

The present invention relates to a simulation apparatus for a system including a motor-driven compressor and a simulation method, and more particularly to a simulation apparatus and a simulation method suitable for evaluating the feasibility of starting the motor-driven compressor system.

(2) Description of the Related Art

For turbo compressor systems handling process gas in petrochemical fields, motor-driven turbo compressors are often selected to downsize the system and to provide expandability and for other reasons. When a new facility is introduced to a plant, or operating conditions of the plant are changed, the system with a motor-driven turbo compressor boots up the compressor until the compressor operates at its rating, which is so called a "startup" operation executed to ensure safe inauguration of the plant. In a plant design phase prior to the actual check operation, every component of the compressor system is designed to have a capacity great enough to avoid startup failure of the compressor system due to a surge, driving torque shortage and so on. For example, a compressor system is constructed so as to calculate the driving torque required to start the compressor and necessary capacity of the driving motor to achieve the rating.

In a case where complicated processes or the like are required, some operators may be trained using a training simulator to understand the operation processes before actual operations. An example of the training simulation is disclosed in JP-A 1998(H10)-333541. The simulator in this publication employs numerical computations to simulate the process operations of a compressor in order to improve simulation accuracy. More specifically, the simulator uses numerical computations to solve simultaneous equations including multiple functions involving process values of gas fed into the compressor and output process values obtained with property values of various kinds of valves installed at an input and output of the compressor as variables, and outputs the output process values of the compressor.

On the other hand, JP-A 2009-47059 discloses a compressor system including a motor-driven compressor provided with an inlet guide vane and anti-surge valve. In order to achieve great facility cost reduction and optimal design, the system sets a startup control line parallel to a surge line and nearer the operation side than an anti-surge control line and operates the compressor along the startup control line during the startup.

SUMMARY OF THE INVENTION

Both the compressor systems in the above-described Japanese patent applications have been made to operate at low costs without producing a surge based on the hypothesis that the compressors are designed in an optimal form. However, seasonal variations, types of gas to be handled and other factors greatly change the operational conditions of the process compressor systems. If the compressor systems need to operate under conditions different from those used for the optimal design, the compressor system cannot always perform optimal operations.

Specifically, in actual operation, a compressor system may need to start the compressor at a pressure a few times higher than a design-point pressure, which means that process conditions at startup are variable. The driving torque required to start up the compressor depends also on the conditions (pressure, temperature, flow rate, etc.) of processes associated with the compressor. Especially, a compressor starting at a high pressure requires more driving torque, and therefore overtorque occurs in the motor with a torque capacity chosen under normal operating conditions, which may hinder the compressor from starting up.

In order to solve the problem, reduction of pressure by discharging gas before startup and, as disclosed in JP-A 2009-47059, controlling the opening degree of a suction throttle valve and inlet guide vane disposed on the suction side of the compressor to adjust the suction pressure of the compressor are carried out to reduce the driving torque. In addition, an anti-surge valve disposed in a gas pipe routing from a pipe on the discharge side to a pipe on the suction side of the compressor is controlled to avoid surging.

However, as described above, when the process conditions at startup are different from specifications designed for general operations, the compressor systems cannot be operated in an optimal operational manner as if it is controlled by sophisticated techniques actually used by operators with practical experiences, for example, pressure control using the suction throttle valve and other valves and flow rate control using the anti-surge valve, to avoid surging. It can be said that there is room for improvement in the operating method and the simulation apparatus.

The present invention has been made to solve the problem and provides a simulation apparatus to provide a motor-driven compressor system that does not suffer from a startup torque shortage and surging, but can operate at low costs.

The present invention is directed to a simulation apparatus for a motor-driven compressor system including a driving motor, a compressor driven by the driving motor, a suction throttle valve controlling an inlet flow rate of the compressor, and an anti-surge valve interposed between pipes for returning a part of gas discharged from the compressor to a suction side of the compressor. The simulation apparatus includes an input section through which designed specification data of the compressor is input, a data setting section storing the designed specification data, a simulation section capable of calculating Q-H characteristics and required driving torque of the compressor in an unsteady state based on the data stored in the data setting section, a display section displaying the resultant unsteady-state Q-H characteristics and required driving torque simulated by the simulation section.

In the preferred simulation apparatus for the motor-driven compressor system, the simulation section includes a driving motor unit model being a mathematical model of the driving motor, a compressor unit model being a mathematical model of the compressor, a suction throttle valve unit model being a mathematical model of the suction throttle valve, an anti-surge valve unit model being a mathematical model of the anti-surge valve, a heat exchanger unit model being a mathematical model of a heat exchanger disposed between the anti-surge valve and the suction side of the compressor, a suction throttle valve controller unit model being a mathematical model of a suction throttle valve controller controlling the suction throttle valve, and an anti-surge valve controller unit model being a mathematical model of an anti-surge valve controller controlling the anti-surge valve. The compressor unit model calculates an operating point and required driving torque of the compressor in an unsteady state. The driving motor unit model calculates unsteady-state behavior of the compressor from a torque characteristic curve of the driving motor and the calculated required driving torque of the compressor.

In the simulation apparatus for the motor-driven compressor system, the simulation section preferably includes a determination section that calculates an operating point and required driving torque of the compressor at startup from the calculated unsteady-state behavior of the operating point and required driving torque of the compressor and determines whether a torque margin of the driving motor and a turndown of the compressor are equal to preset allowable values or lower.

Furthermore, the compressor unit model in the simulation section can include mathematical models expressed by the following Equation 3 to Equation 6, the driving motor unit model can include a mathematical model expressed by the following Equation 7, the suction throttle valve unit model can include a mathematical model expressed by the following Equation 8, and the anti-surge valve unit model can include a mathematical model expressed by Equation 9.

[Expression 1]

$$H_{pol} = \frac{1}{g}\frac{n}{n-1}RT_1\left[\left(\frac{p_2}{p_1}\right)^{\frac{n-1}{n}} - 1\right] \quad \text{Equation 3}$$

$H_{pol}$: polytropic head [m]
g: acceleration of gravity [m/s$^2$]
n: polytropic exponent
R: gas constant [J/kgK]
T: temperature [K]
p: pressure [Pa]

[Expression 2]

$$Q_s(N) = \frac{N}{N_R} f_Q\left[H_{pol}(N)\left(\frac{N_R}{N}\right)^2\right] \quad \text{Equation 4}$$

$Q_s$: inlet flow rate [m$^3$/h]
N: rotational speed [rpm]
$N_R$: rated speed [rpm]
$f_Q$: function expressing inlet flow rate-polytropic head performance curve with the polytropic head
$H_{pol}$: polytropic head [m]

[Expression 3]

$$\eta_{pol}(N) = f_\eta\left[Q_s(N)\frac{N_R}{N}\right] \quad \text{Equation 5}$$

$\eta_{pol}$: polytropic efficiency
N: rotational speed [rpm]
$f_\eta$: function expressing inlet flow rate-polytropic efficiency performance curve with the inlet flow rate
$Q_s$: inlet flow rate [m$^3$/h]
$N_R$: rated speed [rpm]

[Expression 4]

$$L_C = \frac{\dot{m}_s g H_{pol}}{1000\eta_{pol}} \quad \text{Equation 6}$$

$L_c$: compressor shaft power [kW]
$\dot{m}_s$: compressor suction mass flow rate [kg/s]
g: acceleration of gravity [m/s$^2$]
$H_{pol}$: polytropic head [m]
$\eta_{pol}$: polytropic efficiency

[Expression 5]

$$J\left(\frac{2\pi}{60}\right)\frac{dN}{dt} = T_M - \frac{L}{\left(\frac{2\pi}{60}\right)N} \quad \text{Equation 7}$$

J: moment of inertia [kgm$^2$]
N: rotational speed [rpm]
t: time [s]
$T_M$: motor torque [N-m]
L: compressor shaft torque

[Expression 6]

$$\dot{m} = CA\sqrt{2\rho(p_1 - p_2)} \quad \text{Equation 8}$$

$\dot{m}$: mass flow rate [kg/s]
C: flow coefficient
A: cross-sectional area of flow path [m$^2$]
ρ: density [kg/m$^3$]
p: pressure [Pa]

[Expression 7]

$$Q = KA_c\Delta T \quad \text{Equation 9}$$

Q: amount of heat transfer [W]
K: heat transfer coefficient [W/m$^2$K]
$A_c$: heating area [m$^2$]
ΔT: temperature difference [K]
Index 1 denotes an inlet, while index 2 denotes an outlet (hereinafter Indexes 1 and 2 denote the same).

Another aspect of the present invention is directed to a method for simulating a motor-driven compressor system including a driving motor, a compressor driven by the driving motor, a suction throttle valve controlling an inlet flow rate of the compressor, and an anti-surge valve interposed between pipes for returning a part of gas discharged from the compressor to a suction side of the compressor. The simulation method includes the steps of translating components making up the motor-driven compressor system into unit models including mathematical models, calculating unsteady-state behavior of the modeled components, calculating unsteady-state behavior of an operating point and required driving torque of the compressor at startup from the calculated results, and determining whether a torque margin of the driving motor and a turndown of the compressor are equal to preset allowable values or lower based on the resultant behavior to determine the feasibility of starting the compressor.

According to the present invention, the simulation apparatus for a system including a motor-driven compressor is configured to simulate the unsteady state of the compressor system during startup, thereby providing an economical compressor system that does not produce a startup torque shortage and surging.

BRIEF DESCRIPTION OF THE DRAWINGS

Embodiments of the present invention will be described in detail based on the following figures, wherein.

DETAILED DESCRIPTION OF THE INVENTION

Figure 3:
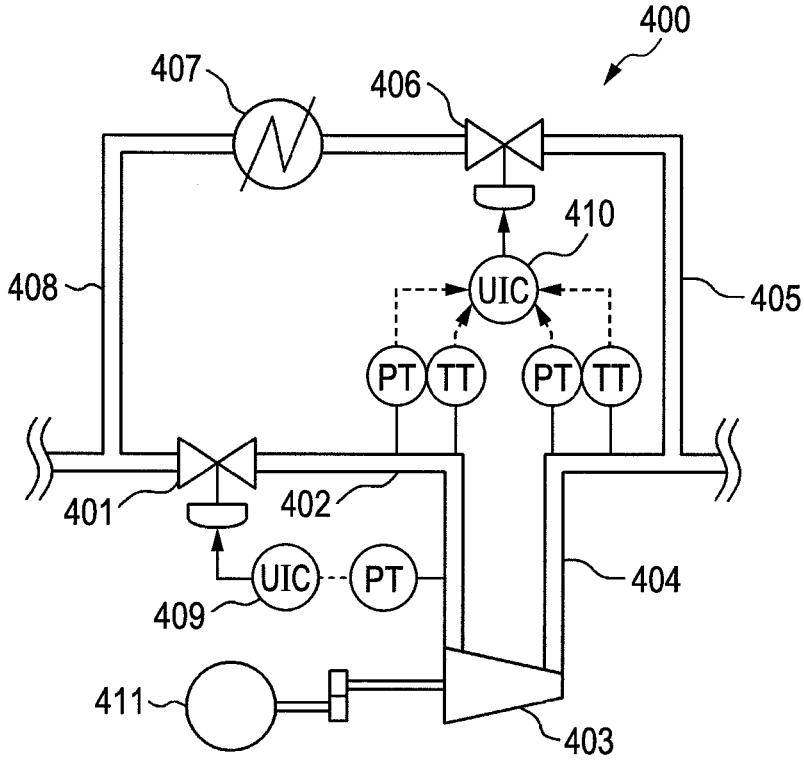
FIG. 3 is a block diagram of a compressor system to be simulated by the simulation apparatus in FIG. 1.

An embodiment of the simulation apparatus according to the present invention will be described with reference to the drawings. In the embodiment, a turbo compressor system 400 shown in FIG. 3 is presented as an exemplary object to be simulated. It is needless to say that the present invention is not limited to the system in FIG. 3.

A single-shaft multi-stage type centrifugal compressor 403 is connected to a driving motor 411 via a speed-up gear or a speed-reduction gear. A suction throttle valve 401 is installed in a suction-side pipe 402 extending from the compressor 403. A discharge-side pipe 404 extending from the compressor 403 is branched into two, and one of which is connected with a return pipe. The return pipe includes a downstream return pipe 405 and an upstream return pipe 408. The upstream return pipe 408 is located upstream of the installation position of the suction throttle valve 401 on the suction-side pipe 402 and is connected to one of branch portions of the suction-side pipe 402. In order from the upstream return pipe 408, a heat exchanger 407 and an anti-surge valve 406 are connected between the upstream return pipe 408 and downstream return pipe 405.

A pressure transducer PT1 is provided between the suction throttle valve 401 on the suction-side pipe 402 and the compressor 403 and sends its output to a suction throttle valve controller 409. The controller 409 adjusts the opening of the suction throttle valve 401 based on the output from the pressure transducer PT1.

In addition, a pressure transducer PT2 and a temperature transducer TT2 are connected to the suction-side pipe 402 and located nearer to the suction throttle valve 401 than the installation position of the pressure transducer PT1 (upstream side). On the other hand, a pressure transducer PT3 and a temperature transducer TT3 are connected to some midpoint of the discharge-side pipe 404 of the compressor 403 and located nearer to the compressor 403 than the downstream return pipe 405 (upstream side).

The pressure transducers PT2, PT3 and temperature transducers TT2, TT3 send their outputs to an anti-surge valve controller 410. The controller 410 controls the opening of the anti-surge valve 406 based on the outputs from the pressure transducers PT2, PT3 and temperature transducers TT2, TT3. FIG. 3 does not show a portion of the return pipe from the branch point on the upstream side onward and a portion of the return pipe from the branch point on the downstream side onward.

Next, a description will be made about the simulation apparatus 1 that simulates the operations of the compressor system 400 including thus configured electric-motor driven turbo compressor with reference to a block diagram in FIG. 1 and a flow chart in FIG. 2.

The description will begin with the general outlines of the embodiment. Operating condition data, specifications and property data of components, which will be described later, regarding the compressor system 400 can be set through a data setting section 50. A display section 30 is provided to show graphed prediction results of a torque margin of the driving motor 411 and a compressor operating point (turndown).

The simulation apparatus 1 separately translates respective components making up the compressor system 400 being simulated into mathematical models and describes them as unit models 401*a* to 411*a* that are then stored in a simulation section 40 together with information about the interrelationship of the connected components. The unit models 401*a* to 411*a* contain data about not only geometric shapes of the components, but also the state quantity of gas flowing in the components. The simulation section 40 can therefore simulate the state of the gas flowing in the compressor system 400, such as pressure, temperature, and flow rate.

Specifically, when an operator who simulates the operating state of the motor-driven compressor system 400 inputs operating condition data including pressure and temperature at startup and specification data including dimensions of pipes in the compressor system 400 and property data of the compressor 403, the simulation section 40 calculates the operating point and required driving torque of the compressor 403, rpm behavior, and gas flowing state including system pressure, temperature and flow rate. From the calculated operating point, driving torque, rpm behavior and gas flowing state, a torque margin of the driving motor 411 in the compressor system 400 being simulated and a history of an operating point and a turndown in the course of startup of the compressor 403 are calculated and the results are output to the display section 30.

The simulation section 40 and data setting section 50 are incorporated in a calculator 20. The sections are computing programs and can be stored in a storage section in the calculator 20 in advance or can be uploaded from an external storage device as needed.

Detailed descriptions about the simulation apparatus 1 will be given below. In response to input of setting input conditions of the compressor system 400 being simulated from the input section 10, the calculator 20 calculates the operating state of the compressor system 400 along with the input conditions. For example, the calculator 20 performs unsteady calculations to determine the operating state of the compressor system 400 during startup from rest at 0 rpm to the rated operation and outputs the calculated results to the display section 30. The input section 10 may be a keyboard or mouse, while the display section 30 may be a monitor.

The setting input data input through the input section 10 contains, for example, specification data of the components 401 to 411 making up the compressor system 400, physical property data of gas flowing in the compressor system 400, and process condition data used to simulate the compressor system 400. More specifically, the component specification data includes design specification data about the compressor 403, specification data about the pipes 402, 404, 405, 408, specification data about the heat exchanger 407, specification data about the suction throttle valve 401, specification data about the anti-surge valve 406, specification data about the driving motor 411, specification data about the suction throttle valve controller 409, and specification data about the anti-surge valve controller 410.

The design specification data about the compressor 403 contains the rated speed, the Q-H characteristic curve representing the relationship between an inlet flow rate and a polytropic head at the rated speed, the efficiency curve representing the relationship between an inlet flow rate and polytropic efficiency at the rated speed, the surge line indicating the bondary where a surge occurs in the compressor 403, and the moment of inertia of a rotor rotating in the compressor 403.

The specification data about the pipes 402, 404, 405, 408 contains information about the length and diameter of the pipes. The specification data about the heat exchanger 407 contains information about the heat-exchangeable capacity, designed inlet temperature, designed outlet temperature, and so on. The specification data about the suction throttle valve 401 and anti-surge valve 406 contains the inherent flow characteristics representing the relationship between the opening degree of the valves and flow rate, the dead time required for the valves 401, 406 to actually start their operations after receiving a command signal, the full-stroke operating time required for the valves 401, 406 to operate at a fully open state from totally enclosed state, and the flow coefficient Cv of the valves 401, 406.

The specification data about the driving motor 411 contains the torque characteristic curve representing the relationship between the rotational speed and torque of the motor 411, the rated speed of the motor 411, the moment of inertia of rotating parts, including the speed-reduction gear or speed-up gear, a coupling and shaft, those making up a transfer mechanism for transferring power of the motor 411 to the compressor 403, and the deceleration ratio of the speed-reduction gear or the acceleration ratio of the speed-up gear. The specification data about the suction throttle valve controller 409 and anti-surge valve controller 410 contains tuning gain to control the opening degree of the valves 401, 406 by PID control.

The physical property data about gas flowing in the compressor system 400 contains the compositions and average molecule weight of the gas, enthalpy data, compressibility factor data and so on. The compressibility factor is a correction factor Z when a real-gas state equation is expressed by $P=Z\rho RT$, where P is pressure (Pa), Z is pressure factor, ρ is density (kg/m$^3$), R is a gas constant (J/kg·K), and T is temperature (K).

The process condition data used to simulate the operation of the compressor 403 contains the piping arrangement, the layout of the anti-surge valve 406 and suction throttle valve 401, the system configuration including group configuration of the compressor 403 and the gas pressure and temperature conditions when the compressor 403 is in a resting state (at startup).

Specifically, the piping arrangement is a piping configuration representing the path through which suction gas or discharge gas flows in the compressor, for example, the branch position and joint position of the process pipes. The layout of the suction throttle valve 401 indicates how far the suction throttle valve 401 is, on the pass, away from the inlet port or outlet port of the compressor. The system configuration indicates categories to which the compressor belongs, for example, a category of compressors having only a single stage, a category of compressors having multiple stages connected in series, a category of compressors having multiple stages connected in parallel, and so on.

Function data of the simulation section 40 is also set through the input section 10. The content includes combining component unit models, such as piping models, according to components making up the compressor system 400 to be simulated. More specifically speaking, the component unit models are represented in the form of a subroutine program according to the component configuration of the plant to be simulated, and the subroutines are constructed on a main program.

Next, the simulation section 40 will be described in detail. The simulation section 40 has unit models 401*a* to 411*a* corresponding to components 401 to 411 in the compressor 400, respectively. Each of the unit models 401*a* to 411*a* is converted into a subroutine and stored in the calculator 20 as programs.

The unsteady states of the gas flowing in the pipes 402, 404, 405, 408 around the compressor 403 are modeled into pipe unit models 402*a*, 404*a*, 405*a*, 408*a*. The heat exchanger 407 is modeled into a heat exchanger unit model 407*a*. The anti-surge valve 406, whose opening is controlled according to the inlet flow rate of the compressor 403, is translated into a mathematical model to construct an anti-surge valve unit model 406*a*.

The operating point and required driving torque of the compressor 403 in an unsteady state are modeled to construct a compressor unit model 403*a*. A motor unit model 411*a* is constructed so as to calculate the rpm behavior of the compressor 403 using the rpm-torque characteristics of the driving motor 411 and calculation results of required driving torque obtained by the compressor unit model 403*a*.

The suction throttle valve 401, whose opening is controlled according to the suction pressure of the compressor 403, is modeled into a suction throttle valve unit model 401*a*. The valve controllers 409, 410, which produce command signals to control the opening of the suction throttle valve 401 and anti-surge valve 406 and output the signals to valve actuators of the valves 401, 406, are translated into mathematical models to construct valve controller unit models 409*a*, 410*a*.

Figure 1:
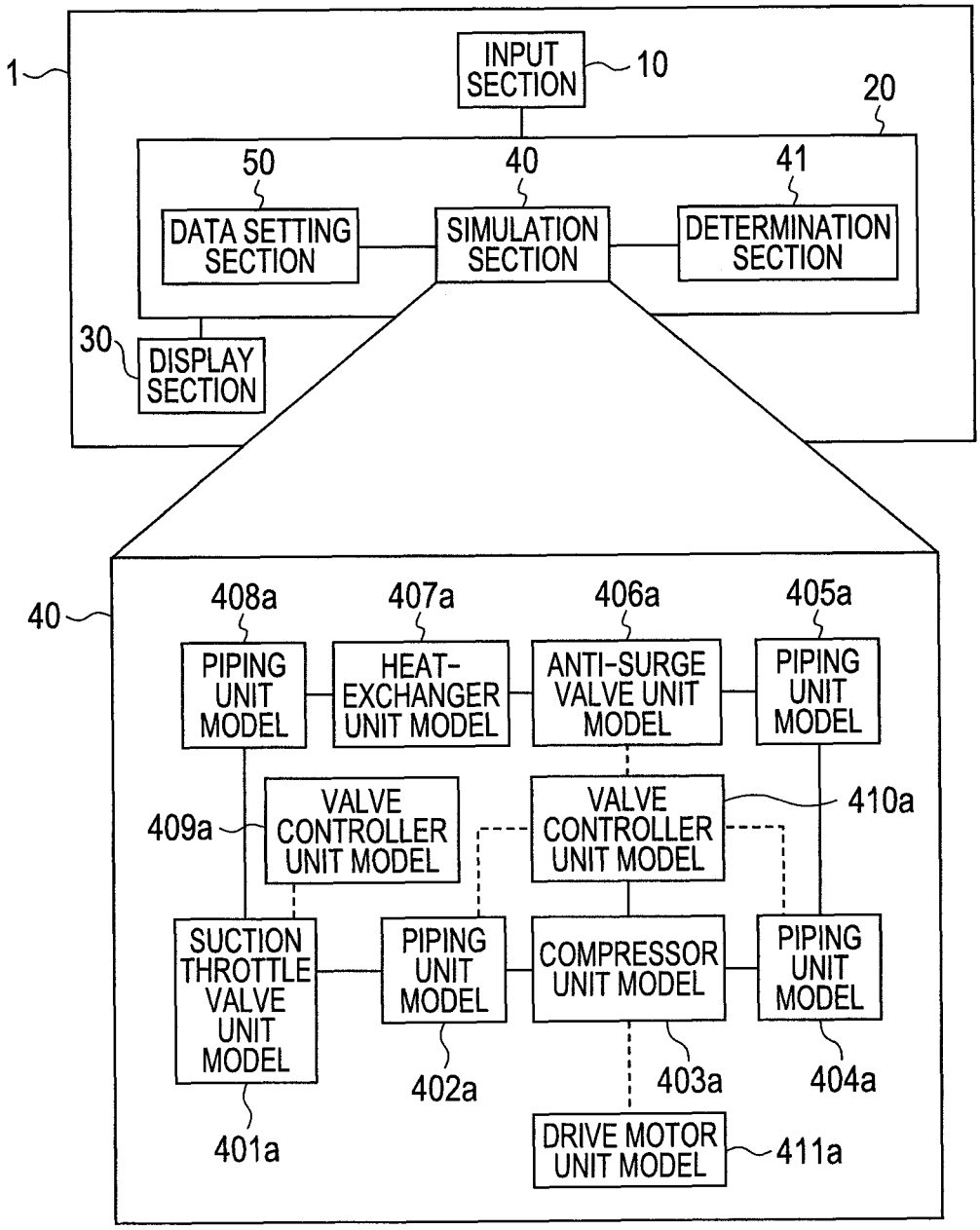
FIG. 1 is a block diagram showing an embodiment of the simulation apparatus according to the present invention.

Solid lines connecting some of the unit models in the simulation section 40 in FIG. 1 are lines for transferring state quantities, such as pressure and temperature of the process gas, while dashed lines connecting some are lines for transferring control signals and electrical signals. As described above, the respective unit models 401*a* to 411*a* in the simulation section 40 are represented as mathematical models of the components 401 to 411 making up the compressor system 400.

More specifically, the pipe unit models 402*a*, 404*a*, 405*a*, 408*a*, which are mathematical models of the pipes 402, 404, 405, 408, are expressed by an equation of continuity (Equation 1) and energy conservation law (Equation 2).

[Expression 8]

$$\frac{dp}{dt} = \frac{p}{T}\frac{dT}{dt} + \frac{p}{\rho V}(\dot{m}_1 - \dot{m}_2) \qquad \text{Equation 1}$$

p: pressure [Pa]
t: time [s]
T: temperature [K]
ρ: density [kg/m$^3$]
V: volume [m$^3$]
ṁ: mass flow rate [kg/s]

[Expression 9]

$$\frac{dh}{dt} = \frac{1}{\rho V}(\dot{m}_1 h_1 - \dot{m}_2 h_2) \qquad \text{Equation 2}$$

h: enthalpy [J/kg]
t: time [s]
ρ: density [kg/m$^3$]
V: volume [m$^3$]

The compressor unit model 403*a*, which is a mathematical model of the compressor 403, is expressed by a polytropic head equation (Equation 3), an inlet flow rate equation (Equation 4), a polytropic efficiency equation (Equation 5), and a required driving torque equation for the compressor (Equation 6).

[Expression 10]

$$H_{pol} = \frac{1}{g}\frac{n}{n-1}RT_1\left[\left(\frac{p_2}{p_1}\right)^{\frac{n-1}{n}} - 1\right] \quad \text{Equation 3}$$

[Expression 11]

$$Q_s(N) = \frac{N}{N_R}f_Q\left[H_{pol}(N)\left(\frac{N_R}{N}\right)^2\right] \quad \text{Equation 4}$$

[Expression 12]

$$\eta_{pol}(N) = f_\eta\left[Q_s(N)\frac{N_R}{N}\right] \quad \text{Equation 5}$$

[Expression 13]

$$L_C = \frac{\dot{m}_s g H_{pol}}{1000\eta_{pol}} \quad \text{Equation 6}$$

The driving motor unit model 411*a*, which is a mathematical model of the driving motor 411, is expressed by a torque equilibrium equation (Equation 7).

[Expression 14]

$$J\left(\frac{2\pi}{60}\right)\frac{dN}{dt} = T_M - \frac{L}{\left(\frac{2\pi}{60}\right)N} \quad \text{Equation 7}$$

The suction throttle valve unit model 401*a* and anti-surge valve unit model 406*a*, which are mathematical models of the suction throttle valve 401 and anti-surge valve 406, are expressed by a flow rate equation (Equation 8).

[Expression 15]

$$\dot{m}=CA\sqrt{2\rho(p_1-p_2)} \quad \text{Equation 8}$$

The heat exchanger unit model 407*a*, which is a mathematical model of the heat exchanger 407, is expressed by a heat amount equation (Equation 9).

[Expression 16]

$$Q=KA_c\Delta T \quad \text{Equation 9}$$

Figure 4:
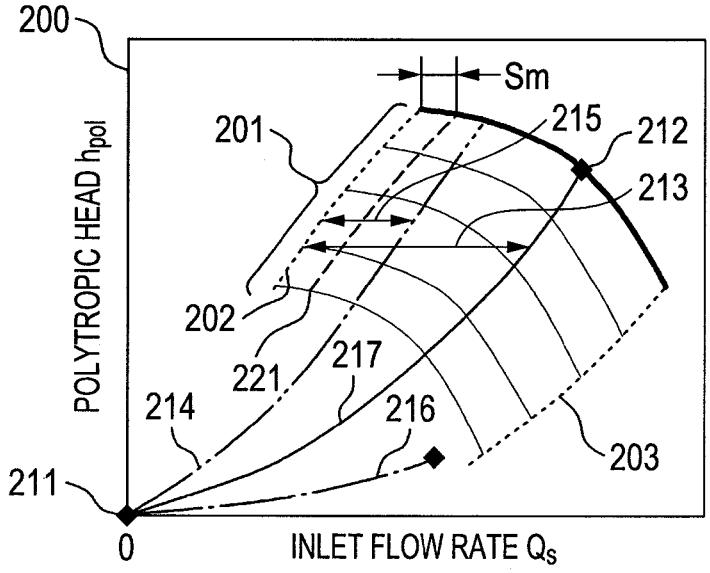
FIG. 4 is a graph showing an example of simulation results obtained by the simulation apparatus in FIG. 1.

The suction throttle valve controller unit model 409*a* controls the suction throttle valve 401 to open at a fixed degree or at a degree according to the pressure of the suction-side pipe 402. The anti-surge valve controller unit model 410*a* controls the anti-surge valve 406 according to a surge control line 221 that is obtained with, as input values to the controller unit model 410*a*, the inlet flow rate of the compressor 403 obtained by Equation 4 and the polytropic head obtained by Equation 3 with a pressure and temperature of the gas in the suction-side pipe 402 and discharge-side pipe 404 of the compressor 403 (See FIG. 4). As shown in FIG. 4, the surge control line 221 is obtained by calculating polytropic heads, based on the rotational speed, at flow rates increased by adding only a surge control margin Sm to flow rates on a surge limit line 202 of the compressor 403, and connecting the calculated polytropic heads.

Thus configured simulation section 40 displays the process condition data, which is setting input data, on the display section 30 as a result at simulation time 0. Then, the simulation section 40 performs calculations for every simulation time step using the mathematical models of the component unit models 401*a* to 411*a*, and displays the calculation results all together on the display section 30. The displayed calculation results include, for example, the pressure, temperature and flow rate of the gas in the components 401 to 411, and the compressor speed.

The data setting section 50 stores the specification data of the components 401 to 411 making up the compressor system 400, physical property data of the gas flowing in the compressor system 400, and process condition data used to simulate the compressor system 400, those of which are setting input data input through the input section 10.

Figure 2:
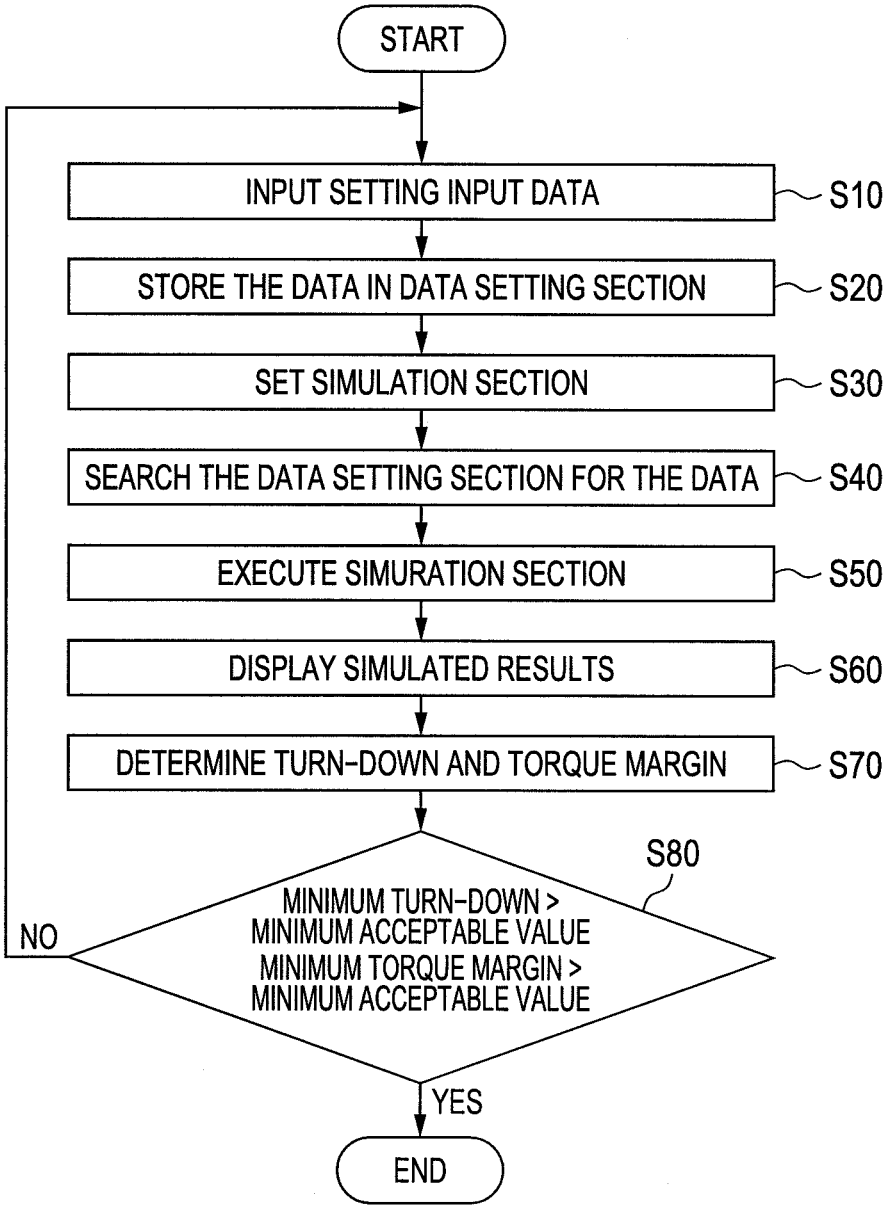
FIG. 2 is a flow chart describing operations of the simulation apparatus shown in FIG. 1.

With reference to FIG. 2, a description will be made about a procedure of the thus configured simulation apparatus 1 to simulate the feasibility of starting the compressor. FIG. 2 is a flow chart to determine whether the compressor system 400 of the present invention can start or not. In step S1, setting input data, such as operating condition data and component specification data, is input through the input section 10. In this embodiment, in addition to the specification data about the components 401 to 411, process condition data containing information of pressure and temperature at startup is input as the setting input data.

In step S20, the setting input data input in step S10 is stored in data setting section 50. In step S30, the configuration of the compressor system 400, which will be determined if it can start or not, is set in the simulation section 40 through the input section 10. In other words, as shown in FIG. 1, a compressor system model 400*a* is constructed as a combination of the component unit models 401*a* to 411*a* based on the configuration diagram shown in the FIG. 3.

As described above, the suction throttle valve unit model 401*a* simulates the valve 401 whose opening is controlled according to the suction pressure and flow rate of the compressor 403. The pipe unit model 402*a* simulates the pipe 402 introducing the gas having passed through the suction throttle valve 401 to the compressor 403. The compressor unit model 403*a* simulates the compressor 403. The pipe unit model 404*a* simulates the pipe 404 introducing the gas whose pressure was raised by the compressor 403 to a downstream process. The pipe unit model 405*a* simulates the pipe 405 that is branched from the pipe 404 to recycle the gas to the suction side of the compressor 403. The anti-surge valve unit model 406*a* simulates the anti-surge valve 406 whose opening is controlled according to the inlet flow rate of the compressor 403 to adjust the flow to be recycled. The heat exchanger unit model 407*a* simulates the gas cooler 407 for cooling the gas. The pipe unit model 408 simulates the pipe 408 introducing the gas again to the inlet side of the compressor 403. The valve controller unit models 409*a*, 410*a* simulate the controller 409, 410 controlling the opening of the suction throttle valve 401 and anti-surge valve 406. The driving motor unit model 411*a* simulates the motor 411 driving the compressor 403.

In step S40, the setting input data stored in step S20 is retrieved from the data setting section 50. In step S50, the simulation section 40 constructed in step S30 is subjected to computational simulations using the setting input data retrieved in step S40. The computations are executed for the mathematical models of component unit models 401*a* to 411*a* at every simulation time step. The calculation results in step S50 are displayed on the display section 30 in step S60.

Figure 5:
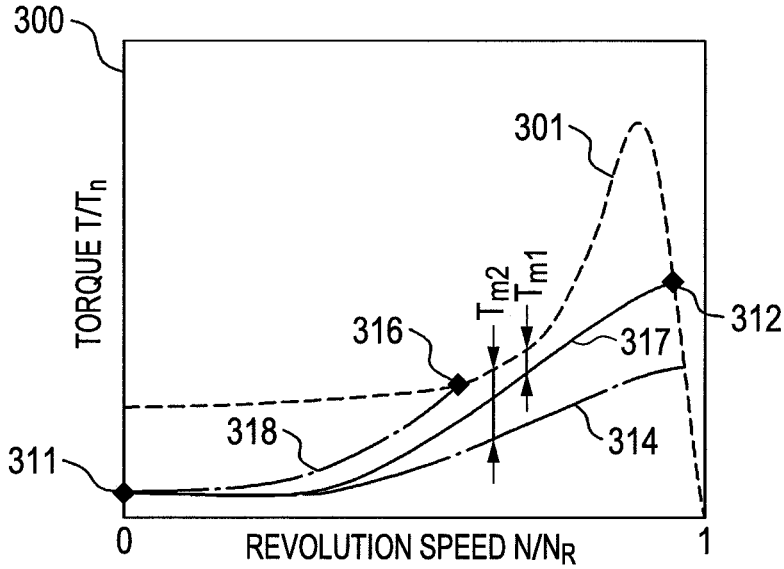
FIG. 5 is a graph showing an example of simulation results obtained by the simulation apparatus in FIG. 1.

FIG. 4 shows, in a Q-H chart 200, an example of resultant Q-H characteristics, which represent the relationship between the inlet flow rate $Q_s$ of the compressor and polytropic head $h_{pol}$, of the compressor system 400 shown in FIG. 3. FIG. 5 shows, in an rpm-torque chart 300, an example of required driving torque of the compressor 403 and torque characteristics of the driving motor 411 of the compressor system 400 shown in FIG. 3. The required driving torque of the compressor 403 is obtained by computations, while the torque characteristics of the driving motor 411 are default values, such as catalog values.

In FIG. 4, the Q-H characteristic curve 201 presents the Q-H characteristics according to speed within an operation range of the compressor 403. A surge limit line 202 is a boundary where a surge occurs in the compressor 403. A choke line 203 is a boundary where a choke occurs in the compressor 403. A line 301 in FIG. 5 indicates torque of the driving motor 411 (torque line).

The calculation examples in FIGS. 4 and 5 imply the following operation state. At simulation time 0, the driving motor 411 and compressor 403 are at rest. FIG. 4 shows that the initial operating point 211 of the compressor 403 is positioned at the origin point (0, 0). FIG. 5 shows that the compressor needs a driving torque to overcome static friction at the initial operating point 311.

As the simulation process continues, the driving motor 411 starts in simulation. With the startup, the compressor 403 gradually accelerates and reaches its rated speed. As is apparent from the Q-H characteristic chart in FIG. 4, the operating point moves from the origin point (0, 0) along a curve 217 to the operating point 212 on the Q-H characteristic curves 201 at 100% speed. Simultaneously, the required driving torque shown in FIG. 5 varies with the acceleration of the speed as shown by a curve 317 and eventually reaches a synchronous speed with the driving torque value of the motor 411 at the operating point 312.

In step S70, a turndown 213 with respect to the operating points of the compressor 403 presented in time increments in step S60 and a torque margin 313 of the driving motor 411 to the required driving torque are determined. The turndown is an amount $S_{td}$ expressed by $S_{td}(\%)=(1-Q_{td}/Q)\times 100$, and in other words, the turndown is a ratio of variation in gas flow from the operating point of the compressor 403 to the surge limit line. In the above equation, $Q_{td}$ denotes a gas flow at the surge limit and Q denotes a gas flow at the operating point. If the minimum turndown value and the minimum torque margin value are both greater than acceptable minimum values defined in the compressor designing stage, a determination section 41 attached to or built in the simulation section 40 determines that the compressor system 400 set up in step S10 can start up.

In a different case, for example, where simulation is executed with the suction throttle valve 401 with an opening set excessively small, the required driving torque shown in FIG. 5 decreases from curve 317 to curve 314, while the torque margin increases from $T_{m1}$ to $T_{m2}$. On the other hand, the operating point of the compressor 403 shown in FIG. 4 shifts to the low flow rate side, i.e., from curve 217 to curve 214, resulting in the reduced turndown 215. If simulation is made, as another example, with the suction throttle valve 401 with an opening set excessively large, the operating point of the compressor 403 in FIG. 4 shifts to the high flow rate side, i.e., from curve 217 to curve 216, while the required driving torque in FIG. 5 increases to curve 318 and is excessively larger than the driving torque 301 of the motor 411 at the operating point 316. As a result, the compressor 403 cannot reach its rated speed.

These two examples show unfavorable simulation results: the former causes the turndown of the compressor 403 to fall short of the minimum allowable turndown value; and the latter causes the torque margin to fall short of the minimum allowable torque margin value. These results suggest that activation of the compressor 403 in the compressor system 400 constructed in step S10 is inappropriate.

As described above, in a compressor system including a suction throttle valve, anti-surge valve and motor-driven compressor, the startup operation of the compressor involving opening adjustment of the suction throttle valve is simulated. According to the embodiment, the compressor system is simulated in anticipation of process pressure conditions that could be different from those in real operation, and various controls and operations of the valves. Even if the compressor is in an unsteady state, or at start up, over-torque and surging can be prevented. Accordingly, the simulation apparatus can determine the feasibility of starting the motor-driven compressor in the compressor system.

In addition, the components making up the compressor system are translated into unit models to simulate the compressor system. Even if the components or gas conditions are changed, the changes can be handled by changing the unit models, which means that the configuration of the simulation section can be freely changed. Therefore, the simulation apparatus can simulate variously-configured systems in consideration of the behavior of the systems in an unsteady state.

Although the above embodiment is described focusing on the startup operation, it is needless to say that the present invention can be applied to transient phenomenon or the like in addition to the startup operation. Moreover, the present invention does not limit the configuration of the compressor system, and any compressor system, as long as it includes a motor-driven compressor, is applicable.

It should be understood by those skilled in the art that various modifications, combinations, sub-combinations and alterations may occur depending on design requirements and other factors insofar as they are within the scope of the appended claims or the equivalents thereof.

What is claimed is:

1. A simulation apparatus for a motor-driven compressor system including a driving motor, a compressor driven by the driving motor, a suction throttle valve controlling an inlet flow rate of the compressor, and an anti-surge valve interposed between pipes for returning a part of gas discharged from the compressor to a suction side of the compressor, the simulation apparatus comprising:

an input section through which designed specification data of the compressor is input;

a data setting section storing the designed specification data;

a simulation section capable of calculating Q-H characteristics and required driving torque of the compressor in an unsteady state based on the data stored in the data setting section; and a display section displaying the resultant unsteady-state Q-H characteristics and required driving torque simulated by the simulation section;

the simulation section includes a driving motor unit model being a mathematical model of the driving motor, a compressor unit model being a mathematical model of the compressor, a suction throttle valve unit model being a unit model of the suction throttle valve, an anti-surge valve unit model being a mathematical model of the anti-surge valve, a heat exchanger unit model being a mathematical model of a heat exchanger disposed between the anti-surge valve and the suction side of the compressor, a suction throttle valve controller unit model being a mathematical model of a suction throttle valve controller controlling the suction throttle valve, and an anti-surge valve controller unit model being a mathematical model of an anti-surge valve controller controlling the anti-surge valve, the compressor unit model calculates an operating point and required driving torque of the compressor in an unsteady state, and the driving motor unit model calculates unsteady-state behavior of the compressor from a torque characteristic curve of the driving motor and the calculated required driving torque of the compressor;

wherein the compressor unit model in the simulation section includes mathematical models expressed by the following Equation 3 to Equation 6, the driving motor unit model includes a mathematical model expressed by the following Equation 7, the suction throttle valve unit model includes a mathematical model expressed by the following Equation 8, and the anti-surge valve unit model includes a mathematical model expressed by Equation 9:

[Expression 1]

$$H_{pol} = \frac{1}{g}\frac{n}{n-1}RT_1\left[\left(\frac{p_2}{p_1}\right)^{\frac{n-1}{n}} - 1\right] \quad \text{Equation 3}$$

$H_{pol}$: polytropic head [m]
g: acceleration of gravity [m/s$^2$]
n: polytropic exponent
R: gas constant [J/kgK]
T: temperature [K]
p: pressure [Pa]

[Expression 2]

$$Q_s(N) = \frac{N}{N_R} f_Q\left[H_{pol}(N)\left(\frac{N_R}{N}\right)^2\right] \quad \text{Equation 4}$$

$Q_s$: inlet flow rate [m$^3$/h]
N: rotational speed [rpm]
$N_R$: rated speed [rpm]
$f_Q$: function expressing inlet flow rate-polytropic head performance curve with the polytropic head
$H_{pol}$: polytropic head [m]

[Expression 3]

$$\eta_{pol}(N) = f_\eta\left[Q_s(N)\frac{N_R}{N}\right] \quad \text{Equation 5}$$

$\eta_{pol}$: polytropic efficiency
N: rotational speed [rpm]
$f_\eta$: function expressing inlet flow rate-polytropic efficiency performance curve with the inlet flow rate
$Q_s$: inlet flow rate [m$^3$/h]
$N_R$: rated speed [rpm]

[Expression 4]

$$L_C = \frac{\dot{m}_s g H_{pol}}{1000\eta_{pol}} \quad \text{Equation 6}$$

$L_c$: compressor shaft power [kW]
$\dot{m}_s$: compressor suction mass flow rate [kg/s]
g: acceleration of gravity [m/s$^2$]
$H_{pol}$: polytropic head [m]
$\eta_{pol}$: polytropic efficiency

[Expression 5]

$$J\left(\frac{2\pi}{60}\right)\frac{dN}{dt} = T_M - \frac{L}{\left(\frac{2\pi}{60}\right)N} \quad \text{Equation 7}$$

J: moment of inertia [kgm$^2$]
N: rotational speed [rpm]
t: time [s]
$T_M$: motor torque [N-m]
L: compressor shaft torque

[Expression 6]

$$\dot{m} = CA\sqrt{2\rho(p_1 - p_2)} \quad \text{Equation 8}$$

$\dot{m}$: mass flow rate [kg/s]
C: flow coefficient
A: cross-sectional area of flow path [m$^2$]
ρ: density [kg/m$^3$]
p: pressure [Pa]

[Expression 7]

$$Q = KA_c\Delta T \quad \text{Equation 9}$$

Q: amount of heat transfer [W]
K: heat transfer coefficient [W/m$^2$K]
$A_c$: heating area [m$^2$]
ΔT: temperature difference [K]
Index 1 denotes an inlet, while index 2 denotes an outlet.

2. The simulation apparatus for a motor-driven compressor system according to claim 1, wherein the simulation section includes a determination section that calculates an operating point and required driving torque of the compressor at startup from the calculated unsteady-state behavior of the operating point and required driving torque of the compressor and determines whether a torque margin of the driving motor and a turndown of the compressor are equal to preset allowable values or lower.

* * * * *